US006375377B1

(12) United States Patent
Lowery

(10) Patent No.: US 6,375,377 B1
(45) Date of Patent: Apr. 23, 2002

(54) AUTOMOTIVE PAINT RESTORATION TOOL AND METHOD

(75) Inventor: Robert Lowery, 8247 Forest Lake Dr., Conway, SC (US) 29526

(73) Assignee: Robert Lowery, Conway, SC (US)

( * ) Notice: Subject to any disclaimer, the term of this patent is extended or adjusted under 35 U.S.C. 154(b) by 0 days.

(21) Appl. No.: 09/532,727

(22) Filed: Mar. 22, 2000

(51) Int. Cl.[7] ..... B05L 11/00
(52) U.S. Cl. ..... 401/266; 401/183; 401/265
(58) Field of Search ..... 401/263, 261, 401/265, 266, 183, 184, 185, 267, 136, 139, 25, 26, 188 A, 188 R, 6, 137, 138

(56) References Cited

U.S. PATENT DOCUMENTS 2,559,553 A * 7/1951 Wolff ..... 401/266
2,746,461 A * 5/1956 Bocchino ..... 401/185
2,772,432 A * 12/1956 Andreola ..... 401/263
4,484,976 A * 11/1984 Despins ..... 401/261
5,415,488 A * 5/1995 MacGibbon et al. ..... 401/139
5,755,241 A * 5/1998 Cheung ..... 401/137
5,834,054 A 11/1998 Berry ..... 427/142

* cited by examiner

*Primary Examiner*—David J. Walczak
(74) *Attorney, Agent, or Firm*—Womble Carlyle Sandridge & Rice, PLLC

(57) ABSTRACT

A method for restoring or touching-up blemishes, such as scratches and chips in an automotive paint finish, includes the steps of applying a measured bead of relatively thick matching touch-up paint to a flexible blade and drawing the flexible blade across the blemish to deposit the touch-up paint in the blemish to restore the blemish. A tool for restoring or touching-up blemishes such as scratches and chips in an automotive paint finish, includes a squeezable paint bottle that forms the handle of the tool, a coupler threaded at one end onto the bottle, a blade holder extending from the other end of the coupler to a forward edge, a flexible blade projecting from the forward edge of the blade holder to a free edge, and a nozzle projecting from the forward edge of the blade holder toward the free edge of the flexible blade. A passageway communicates between the squeezable bottle and the vicinity of the blade to deposit a measured amount of touch-up paint onto the blade when the bottle is squeezed, the blade subsequently being drawn over a blemish to deposit the touch-up paint in the blemish.

1 Claim, 2 Drawing Sheets

AUTOMOTIVE PAINT RESTORATION TOOL AND METHOD

TECHNICAL FIELD

The present invention relates generally to vehicle repair and maintenance and more particularly to restoring or touching-up scratches, chips, and small recesses in an automotive paint finish.

BACKGROUND OF THE INVENTION

Blemishes such as scratches, scrapes, chips, gouges, and small recesses in the painted finish of an automobile or other vehicle are unsightly and can reduce the market value of the vehicle. These types of defects can result from a number of causes ranging from accidental scraping with jewelry or other hard objects, to being hit by small rocks, to intentional vandalism, sometimes known as "keying." On occasion, the paint job on a new vehicle may become scratched or scraped during delivery from the factory to a dealership. Obviously, when a new vehicle is damaged in this way, the damage must be repaired before offering the vehicle for sale as new.

Many techniques short of the complete restoration of the affected body panel have been developed for restoring or "touching-up" blemishes in an automotive paint finish. One technique involves the careful painting of the blemish with matching touch-up paint using a small brush. While this technique has been used for years and is the common touch-up method used by car owners and other non-professionals, it nevertheless is not completely satisfactory because the repair usually is obvious upon even casual inspection. This is because the touch-up paint, once dry, forms a small but objectionable mound covering the blemish and the surface of the mound can be lumpy or uneven. Further, the surface of the repair seldom is flush with the surrounding finish and seldom matches the sheen of the surrounding paint, making it stand out even more.

Another touch-up technique involves air brushing the blemished area with a matching touch-up paint. While this technique avoids some of the problems with brushed on touch-up paint, it nevertheless has its own set of shortcomings. For example, relatively expensive air brushing equipment is required, as is the skill and experience needed to operate it effectively. Accordingly, air brush touch-up has generally be limited to use by professional restorers. In addition, the overspray that is an unavoidable attribute of air brushing covers not only the blemish, but also the surrounding area of the finish and must be removed because it is unsightly. The removal process involves careful cleaning of the area immediately surrounding the blemish with a special paint remover, while not disturbing the small amount of paint that fills the blemish. This is a very tedious process requiring skill and experience. Even using the utmost care, however, it is virtually impossible not to disturb the paint in the scratch so some degree and, often, this renders the repair noticeable. Finally, since touch-up paint must generally be relatively thin and liquid to be sprayed, the paint does not tend to fill the blemish fully. This can result in a small but noticeable concavity in the blemish. In some cases, multiple coats must be applied, allowed to dry, and subsequently sanded and buffed to avoid this problem. In any event, it is clear that air brushed touch-up is an expensive, time consuming, tedious, and imperfect technique for restoring scratches and other blemishes in an automotive paint finish.

U.S. Pat. No. 5,834,054 of Berry discloses another method of restoring small blemishes such as scratches and chips that form recesses in an automotive paint finish. The Berry process involves lubricating the region of the finish containing the blemish and applying a deposit relatively thick color matched touch-up paint to an area of the painted surface directly adjacent to the blemish. A squeegee blade is then pulled with pressure first across the deposit of touch-up paint and then across the blemish. The squeegee blade forces the touch-up paint into the recess, thereby filling the recess to hide the blemish. At the same time, the squeegee blade removes excess touch-up paint from areas of the finish surrounding the blemish and also smoothes the surface of the touch-up paint within the blemish so that it is flat and flush with the surrounding finish. After a short drying interval, a soft cloth wetted with a suitable solvent is wiped over the repair to remove any remaining film of touch-up paint on the surrounding finish and the repair is complete.

While the Berry process is an improvement over the manual and air brush techniques discussed above, it nevertheless exhibits certain problems and shortcomings. For example, the touch-up paint itself is contained in separate squeeze bottles and is applied from the squeeze bottles directly to the finish adjacent the blemish. The squeeze bottle is then capped and put away, whereupon a separate squeegee tool is deployed for spreading the touch-up paint into the blemish. As a result, inherent kit maintenance, cleaning, and storage requirements are entailed and the multi-step nature of the process lengthens the time and increases the complexity of the repair. Further, a substantial amount of touch-up paint is wasted during each repair because most of the paint applied to the finish adjacent the blemish is simply wiped away and discarded. Only a small amount of the deposited touch-up paint actually is wiped into the recess of the blemish. While each repair may only result in the waste of a small amount of touch-up paint, the aggregate amount of wasted paint over time can be substantial. For these and other reasons, the Berry process, while an improvement, is not a complete solution.

A need therefore exists for an improved tool and method for restoring small blemishes in an automotive paint finish that addresses the forgoing and other problems inherent in prior methods and that is fast, efficient, economical, and results in a repair that is virtually unnoticeable. It is to the provision of such a tool and method that the present invention is primarily directed.

SUMMARY OF THE INVENTION

Briefly described, the present invention, in a preferred embodiment thereof, comprises a tool for restoring blemishes in a painted finish such as the finish on an automobile. The tool includes a squeezable bottle for containing touch-up paint with the bottle having an externally treaded mouth and being sized and configured to be held comfortably in the hand. An angled coupler has a first end and a second end is provided on its first end with an internally threaded receptacle for threading the coupler onto the mouth of the squeezable bottle. A blade holder is disposed on the second end of the coupler and the blade holder projects from the coupler to a substantially straight forward edge. A flexible blade having opposed surfaces is secured along and projects from the forward edge of the blade holder to a straight free edge. This assembly resembles a squeegee, with the squeezable bottle forming a handle for holding the tool during use.

A small passageway extends through the coupler and the blade holder. The passageway communicates between the treaded receptacle of the coupler and the forward edge of the blade holder at a position adjacent one of the surfaces of the blade. The passageway is sized and positioned to deliver a bead of touch-up paint from the squeezable bottle onto the surface of the blade when the bottle is squeezed gently by a user. The touch-up paint can then be wiped by the blade into a blemish such as a crack or chip in a painted finish to repare the blemish and restore the finish.

The method of the invention comprises applying a measured amount of touch-up paint to one surface of a flexible blade and drawing the flexible blade across a blemish in a painted finish. The blade thus wipes the touch-up paint into the blemish, smoothes the surface of the touch-up paint, and insures that the surface of the touch-up paint within the blemish is flush with the surrounding painted finish. The result is a virtually invisible repair that is accomplished quickly, easily, and economically with far less skill and equipment than is required with prior art restoration techniques. Since only the amount of touch-up paint necessary to fill the blemish is deposited onto the blade, wasted touch-up paint is substantially reduced.

Thus, a unique tool and method is now provided that addresses successfully the problems and shortcomings of the prior art discussed above. A more thorough understanding of the invention will be gleaned upon review of the detailed description of the preferred embodiments set forth below when taken in conjunction with the accompanying drawing figures, which are briefly described as follows. dr

DETAILED DESCRIPTION OF THE PREFERRED EMBODIMENT

Figure 1:
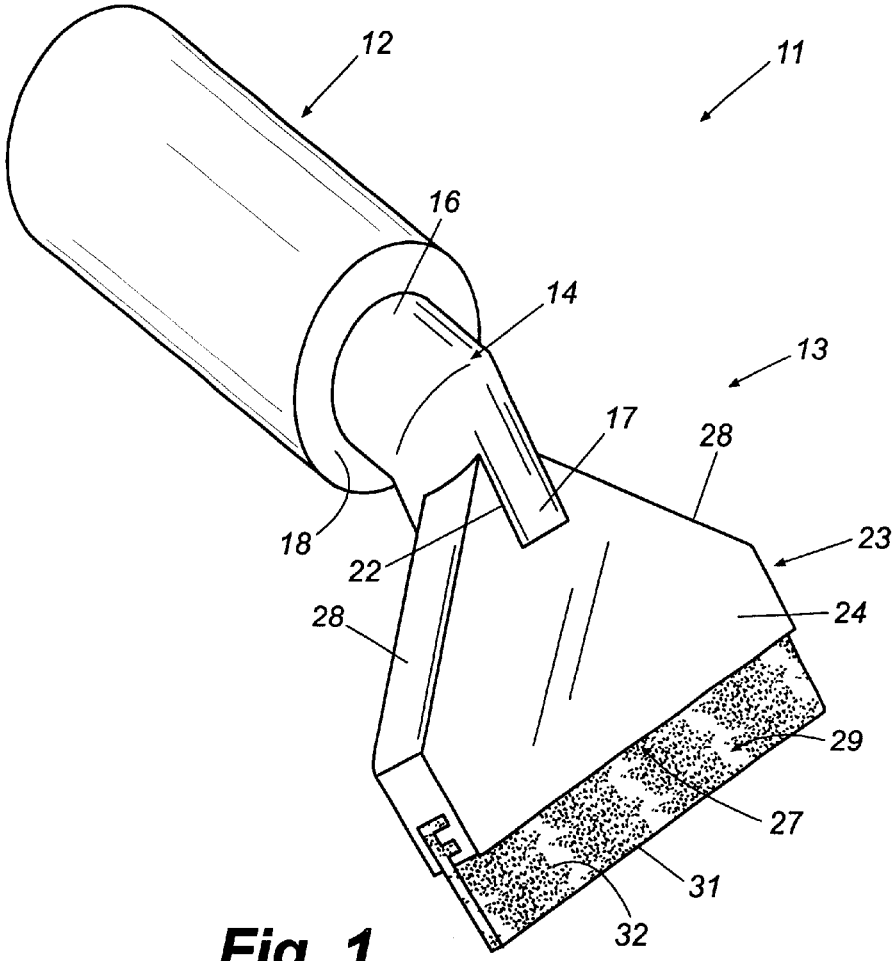
FIG. 1 is a perspective view of an automotive paint restoration tool that embodies principles of the invention in a preferred form.
Figure 2:
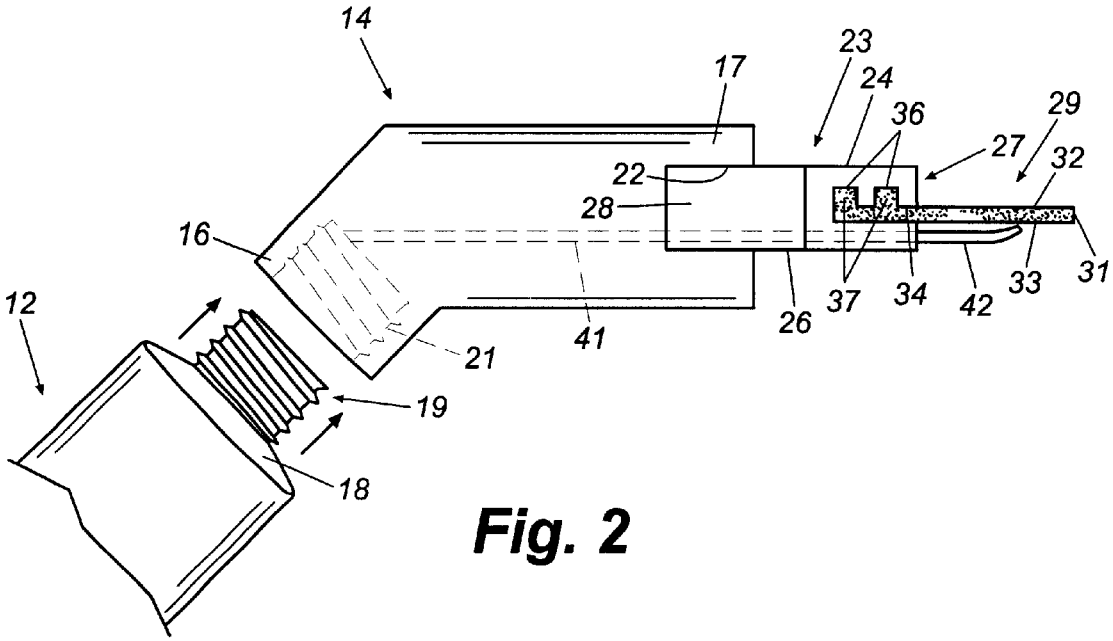
FIG. 2 is a cross-sectional partially exploded view of restoration tool of FIG. 1 showing the internal paint delivery passageway thereof.

Referring now in more detail to the drawings, in which like numerals refer to like parts throughout the several views, FIGS. 1 and 2 depict an automotive paint restoration tool that embodies principles of the invention in a preferred form. The tool 11, which resembles a squeegee in some respects, comprises a generally cylindrical squeezable plastic bottle 12 having a shoulder 18 and an externally threaded open mouth 19 (FIG. 2). The bottle 12 is sized and shaped to be held comfortably in the hand of a user and is adapted to contain a touch-up paint mixture as described in more detail below.

An angled plastic coupler 14 has a first end 16, a second end 17, and is formed with an internally threaded receptacle 21 in its first end 16. The receptacle 21 is configured to be threaded securely onto the externally threaded mouth 19 of the squeezable bottle 12 to cap the bottle and form an angled forward extension thereof. The second end 17 of the coupler 14 is formed with a relatively wide slot 22, which extends into the body of the coupler 14 from the second end thereof. A blade holder 23, which preferably is relatively thick and substantially flat, has a top face 24 and a bottom face 26 (FIG. 2) and is received in the slot 22 where it is securely fixed with an appropriate adhesive such as an epoxy or PVC cement. As an alternative to a separate blade holder cemented in a slot of the coupler, the blade holder 23 and coupler 14 can be formed as a single unitary injection molded plastic component if desired and such fabrication may well be preferable because of its inherent strength and simplicity of assembly. In any event, the blade holder 23 projects forwardly from the coupler 14 to a substantially straight forward edge 27. Further, the blade holder 23 preferably flares outwardly from the coupler defining flared edges 28 and forming a forward edge 27 that preferably is at least several inches long, but that may take on other lengths depending upon intended final use of the tool.

The forward edge 27 of the blade holder is formed with a longitudinally extending slot 34, which preferably but not necessarily extends the full length of the forward edge. The slot 34 is further configured with a pair of internal grooves 36, which in the illustrated embodiment extend at substantially right angles with respect to the slot 34. A flexible blade 29 is disposed and secured within the slot 34 and extends forwardly therefrom to a substantially straight free edge 31. The blade 29 has an upper surface 32 and a lower surface 33 and its rear edge portion extends into the slot 34 formed in the forward edge of the blade holder 23. Further, the rear edge portion of the blade is formed with a pair of projecting tongues 37, which are sized and positioned to be received and held within the grooves 36 formed in the slot 34. In this way, the blade 29 is held firmly and securely within the slot 34 by the cooperating tongues and grooves 37 and 36 respectively. Further, during fabrication, the blade 29 advantageously may be secured within the blade holder 23 by sliding its rear edge portion into the slot 34 from one end of the blade holder. The blade 29 may be formed of any appropriate flexible material such as rubber, polymer, a relatively low durometer PVC plastic, or any other suitable flexible material. In any event, the blade preferably is flexible yet relatively stiff rather like the blade of a traditional squeegee. When the blade 29 is installed in the slot 34, a shoulder 38 (FIG. 3) is formed by the forward edge 27 of the blade holder on either side of the blade 29.

Figure 3:
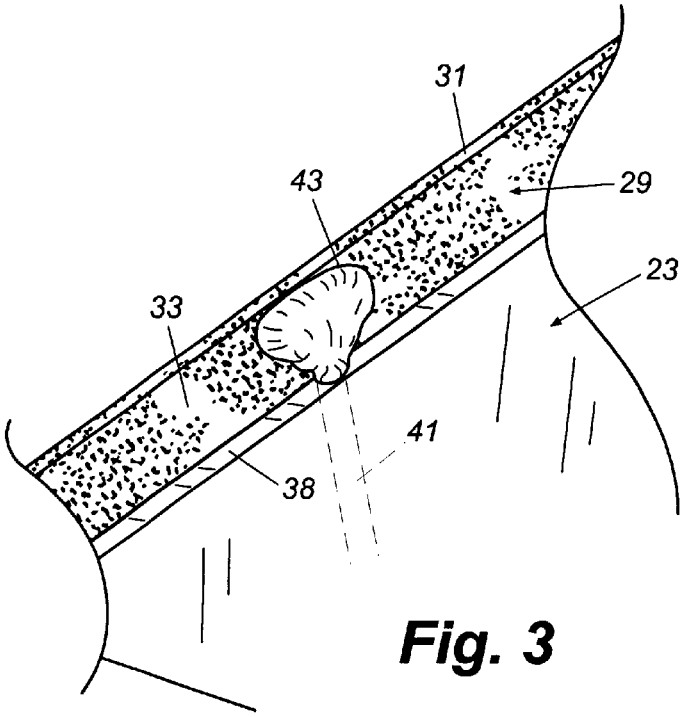
FIG. 3 is a perspective view illustrating the deposit of a bead of touch-up paint on the blade of the restoration tool of this invention in preparation for use to restore a blemish.

A relatively small diameter passageway 41 is formed through the coupler 14 and the blade holder 23. The passageway 41 communicates between the threaded recess 21 in the first end of the coupler and the shoulder 38 adjacent the lower surface 33 of the blade 29. Thus, when the bottle 12 is charged with touch-up paint and threaded into the coupler 14, a gentle squeeze of the bottle forces paint through the passageway 41 and onto the lower surface 33 of the blade 29 (FIG. 3). A tubular extender nozzle 42 may be secured within the end of the passageway 41 if desired to direct and deposit the paint on the lower surface 33 of the blade at a location nearer the free edge 31 thereof, although the invention does not require the use of such an extender nozzle.

Figure 4:
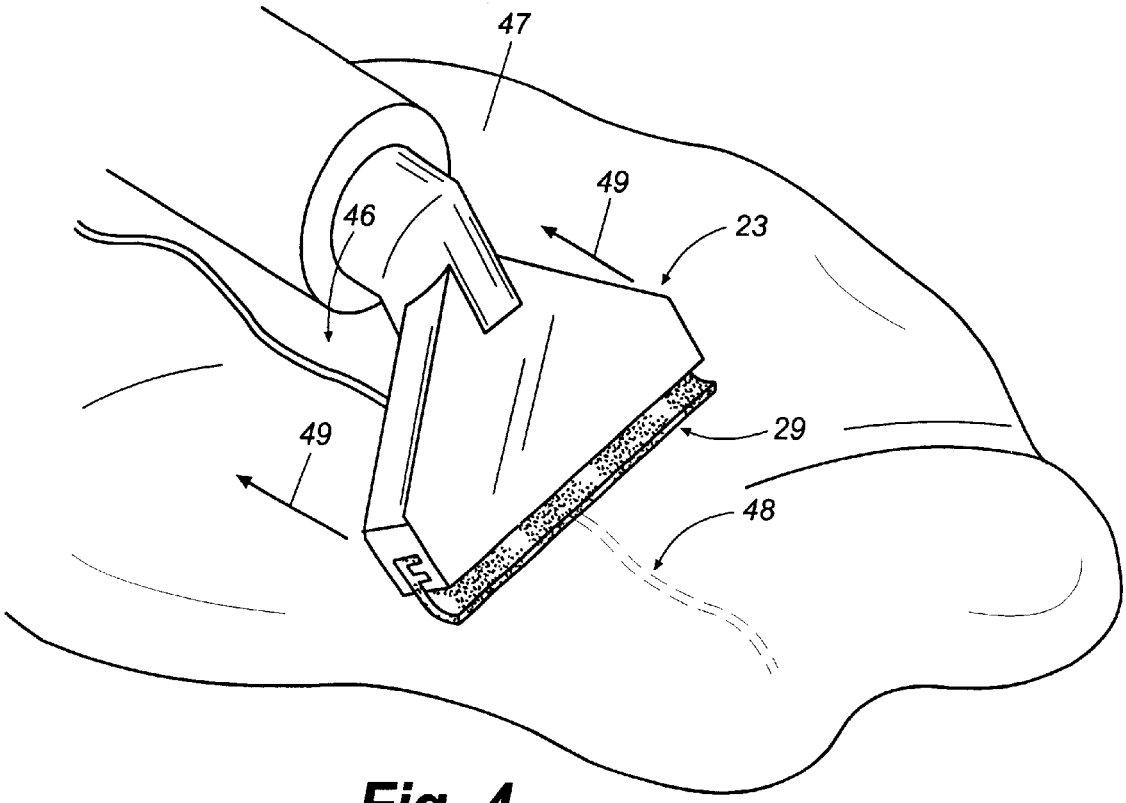
FIG. 4 is a perspective view illustrating use of the restoration tool of this invention to restore a blemish in an automotive paint finish according to the method of the invention.

FIGS. 3 and 4 illustrate generally the best mode known to the inventors of using the tool 11 to repair or restore a blemish such as a scratch or scrape in the painted finish of an automobile. First, the squeezable bottle 12 is at least partially filled with a touch-up paint formulation having a color that matches the color of the painted finish. As described in more detail below, the touch-up paint is specially mixed and formulated to have a rather thick consistency compared to ordinary paint and in this regard preferably has the approximate consistency of a paste. The filled bottle is then threaded into the coupler 14, where the bottle serves the dual purpose of containing a supply of touch-up paint and providing the handle of the tool 11.

The tool preferably is then held upright as shown in FIG. 3 with the blade of the tool extending upwardly or at an angle so that the lower surface 33 of the blade faces generally in an upward direction. The bottle 12 is then squeezed gently until a small dollop or bead of touch-up paint 43 of a predetermined size is deposited onto the lower surface 33 of the blade. Most preferably, the passageway 41 communicates through the shoulder 38 of the blade holder in a central location of the blade intermediate its ends, but this certainly is not a requirement or limitation of the invention. Further, if it is desired to deposit the bead of touch-up paint closer to the free edge 31 of the blade, an extender nozzle 42 may be fitted in the end of the passageway 41 as shown in FIG. 2. In any event, a bead of touch-up paint is deposited on the lower surface of the blade 29 and, significantly, the amount of paint that is deposited can be carefully gauged and controlled by applying the appropriate pressure to the squeezable bottle 12 and observing the flow of paint onto the blade. In this way, only the amount of touch-up paint needed to affect the restoration is used and the significant waste inherent in prior art restoration processes is eliminated.

FIG. 4 illustrates the painted finish 47 of a vehicle having a blemish 46, which is shown as a scratch or scrape, but that may also be a chip, small dent, or other blemish. With a bead of touch-up paint applied to the lower surface of the blade 29 as described above, the tool of the invention is held by the bottle, which now functions as a handle, and the blade 29 is applied to the surface with sufficient pressure to deflect the blade and hold its free edge firmly against the finish. The blade is positioned such that the bead of touch-up paint on the lower surface of the blade is located adjacent the blemish 46. The tool is then pulled steadily in the direction of arrows 49 to draw the blade across the blemish 46. As the blade moves over the blemish 46, the blade wipes a small amount of touch-up paint 48 into the blemish 46 to fill it in much the same way that spackling fills cracks in drywall when applied with a drywall knife. At the same time, the straight free edge of the blade levels and smoothes the surface of the touch-up paint 48 so that it is flat and flush with the surface of the painted finish around the blemish. When the entire length of the blemish 46 has been covered the tool is lifted from the finish leaving the blemish filled and the furnish restored. The bottle can then be removed from the tool by unthreading it from the coupler, whereupon the bottle can be capped and stored until touch-up paint of the same color is needed for a future repair. The tool itself can then be cleaned easily by, for example, threading a bottle of solvent onto the coupler and squeezing it to force solvent through the passageway 41 to remove any paint residue. The blade may be cleaned simply by wiping it with a cloth and solvent and put away for future use.

When the touch-up paint in the blemish has been allowed to dry for a prescribed drying time, which may vary depending upon the composition of the paint, any excess paint or film left on the painted finish is removed with a small amount of solvent, such as acetone or an enamel reducer, and a soft cloth. The entire area of the vehicle containing the repaired blemish may then be buffed if desired to improve the appearance of the repair further. The result is a restoration that is virtually invisible and that is accomplished in a fraction of the time and with a fraction of the skill and waste inherent in prior art restoration processes.

The best mode of practicing the invention will now be described in more detail. It has been found that commercially available touch-up base paints used in prior art manual and air brushing restoration techniques generally do not have the optimum consistency and finished appearance characteristics. Accordingly, certain pre-application formulation is preferable for a consistent high-quality result. The formulation starts with a matching commercial base paint such as, for example, base paints available from the BASF Corporation under the trademarks GLASURIT® or DIAMONT®, each of which is believed to be a polyester-based product. A thickening agent, also commercially available from BASF and others, is then added to the base paint to decrease its viscosity, preferably to the consistency of a soft paste. An organic or polymeric gel also may be used to thicken the base paint and to provide a smooth consistency to the resulting paste. The amount of thickening agent needed may vary depending upon the base paint used, temperature conditions, and other factors. In addition to thickening the touch-up paint, it has been found that the thickening agent also enhances the ability of the paint to suspend the small metal flakes commonly used in automotive metallic finishes, which are popular among many consumers.

After addition of the thickening agent, a commercially available glossing agent is added to the formulation and the mixture is thoroughly blended so that all of the ingredients are evenly distributed. Addition of the glossing agent is preferred in the formulation because it causes the touch-up mixture to take on a glossy sheen as it dries and also provides protection against fading as a result exposure to ultraviolet light, which is a component of sunlight. Without a glossing agent, the touch-up mixture tends to dry to a less glossy matte-like finish and an additional step of clear coating and buffing the area of the restoration is required. Accordingly, including the glossing agent also eliminates a step commonly required in prior art restoration techniques.

As mentioned above, after application of the touch-up mixture with the tool of this invention, relatively minor post application finishing such as wiping with a solvent to remove any film and buffing with a soft cloth may be applied to render the restoration virtually invisible. Hand buffing the entire affected area with a buff enhancer further improves the appearance of the restoration. The final result is a restoration that is flush with the surrounding finish and matches the finish in color and sheen to provide a virtually invisible repair. All of this is accomplished quickly, easily, and economically with the unique and innovative tool and method of the present invention.

The invention has been illustrated and described herein in terms of preferred embodiments and methodologies that represent the best mode known to the inventors of practicing the invention. However, the illustrated embodiments are not intended to, nor should they be construed as, limiting the invention. It will be obvious that a variety of additions, deletions, and modifications of the illustrated embodiments might well be made by persons of ordinary skill in the art without departing from the spirit and scope of the invention as set forth in the claims.

What is claimed is:

1. A tool for restoring blemishes in a painted finish, said tool comprising:

a squeezable bottle for containing touch-up paint, said squeezable bottle having an externally threaded mouth and being sized and configured to be held comfortably in the hand, wherein said squeezable bottle forms a handle of the tool;

a coupler having a first end and a second end and being provided on its first end with an internally threaded receptacle for threading said coupler onto said mouth of said squeezable bottle, wherein said coupler is angled between its ends to provide a comfortable attitude of said handle during use of said tool;

a blade holder disposed on said second end of said coupler, said blade holder projecting from said second end of said coupler to a substantially straight forward edge, wherein said blade holder flares outwardly from said second end of said coupler to said substantially straight forward edge;

a flexible blade having opposed surfaces and being secured along and projecting from said substantially straight edge of said blade holder to a free edge;

a passageway extending through said coupler and said blade holder, said passageway communicating between said treaded receptacle of said coupler and said forward edge of said blade holder adjacent one of said surfaces of said blade for delivering a bead of touch-up paint from said squeezable bottle onto said blade when said bottle as squeezed, the touch-up paint being wiped by said blade into a blemish to restore the blemish; and, a nozzle extending from said passageway at said forward edge of said blade holder toward said free edge of said blade for depositing a bead of touch-up paint adjacent the free edge of said blade when said squeezable bottle as squeezed.

* * * * *